US006675840B2

(12) United States Patent
Jungmann et al.

(10) Patent No.: US 6,675,840 B2
(45) Date of Patent: Jan. 13, 2004

(54) FILL PROBE WITH IN-LINE MIXER

(75) Inventors: Ronald D. Jungmann, Maplewood, MN (US); Roy F. Johnson, St. Paul, MN (US); Richard V. Mullen, Cottage Grove, MN (US)

(73) Assignee: Ecolab, Inc., Mendota Heights, MN (US)

( * ) Notice: Subject to any disclaimer, the term of this patent is extended or adjusted under 35 U.S.C. 154(b) by 83 days.

(21) Appl. No.: 09/960,028

(22) Filed: Sep. 20, 2001

(65) Prior Publication Data

US 2003/0051765 A1 Mar. 20, 2003

(51) Int. Cl.[7] ..... B65B 3/04

(52) U.S. Cl. ..... 141/9; 141/74; 141/90; 141/104; 141/105; 141/255; 141/256; 366/169.1

(58) Field of Search ..... 141/9, 90–91, 141/18, 74, 79, 100, 103, 104, 105, 255, 256, 259, 392; 366/98, 168.1, 169.1, 157.3; 239/306

(56) References Cited

U.S. PATENT DOCUMENTS 2,347,195 A * 4/1944 Huff ..... 366/169.2
4,003,796 A * 1/1977 Muller et al. ..... 435/295.1
4,168,918 A * 9/1979 de Jonge ..... 366/138
4,511,255 A * 4/1985 Saucier ..... 366/138
4,955,723 A * 9/1990 Schneider ..... 366/136
RE34,776 E * 11/1994 Pratt ..... 195/142
5,776,418 A * 7/1998 Besnier et al. ..... 422/68.1
5,967,202 A 10/1999 Mullen et al. ..... 141/104
6,402,361 B1 * 6/2002 Reinemuth ..... 366/136

* cited by examiner

*Primary Examiner*—Timothy L. Maust
(74) *Attorney, Agent, or Firm*—Merchant & Gould P.C.

(57) ABSTRACT

A fill probe with an in-line mixer accelerates and facilitates automation of a fill and mix procedure required in formulating certain chemical products. In some formulas, the concentrated chemical components that combine to form the resulting formula (e.g., teat dip) have a wide range of viscosities. The in-line positioning of the mixing attachment with the fill probe on the outside of the fill probe creates a dual action mixing operation that mixes the components as they are deliver to a mixing container and continues to mix them after they are combined with other chemicals within the mixing container. By using a combination fill probe and in-line mixer of the claimed design, a user can automate the fill and mix process, decrease the required mix time, and reduce foaming and spillage of chemicals.

26 Claims, 6 Drawing Sheets

FILL PROBE WITH IN-LINE MIXER

TECHNICAL FIELD

The invention relates generally to mixing of chemicals, and more particularly, a fill probe with an in-line mixer attached thereto.

BACKGROUND OF THE INVENTION

Chemical products come in a wide variety of mixtures and concentrations. It is not uncommon, therefore, that a chemical product user purchases several highly concentrated chemical components and selectively combines them to produce a desired end product chemical. This combining process is often referred to as "formulation".

For example, a dairy farmer may employ a conditioning agent called "teat dip" to treat the teats of dairy cattle. A common "teat dip" formula may combine ingredients such as glycerine, water, lecithin, chlorhexidine gluconate, polysorbate 80, bees wax components, syphytum extract, and isopropyl alcohol. The resulting formula is typically homogeneous and viscous. Furthermore, the resulting formula tends to foam when mixed with air, which is undesirable.

In existing approaches, the dairy farmer typically inserts an air-driven mixer into a mixing drum containing the concentrated chemical components, some of which may be added during the mixing process. The farmer can then mix the component chemical with the mixer before using the end product chemical (i.e., the teat dip). However, this manual mixing process is time-consuming and costly from a labor perspective because the mixing does not occur until after the chemical components are added to the mixing drum. In addition, the insertion and removal of the manual mixer to and from the tub introduces some spillage of the various chemicals, which is undesirable.

Moreover, some formulation systems, such as that disclosed in U.S. Pat. No. 5,967,202, assigned to the Assignee of the present invention, allow the addition of multiple chemical components at the same time through a common fill line. However manual mixing is still required to produce a homogeneous chemical product.

The variation in viscosity of the chemical components makes existing in-line mixing techniques unsatisfactory for such fill and mix processes. Existing in-line mixers are set entirely into a fill line from the chemical source, but do not mix the chemicals that reside in the end product drum. Such in-line approaches also do not provide a homogeneous end product when chemical component viscosities vary widely.

SUMMARY OF THE INVENTION

Embodiments of the present invention solve the discussed problems using a combination of a fill probe and an in-line mixer to mix the chemical components as they are being added to an end product container as well as after they have been added to the end product container (e.g., the tub). By using a combination fill probe and in-line mixer of the claimed design, a user can automate the fill and mix process, decrease the required mix time, and reduce foaming and spillage of chemicals. In addition, embodiments of the present invention accommodate the addition of multiple chemicals of widely varying viscosities at the same time through the common fill line.

In one embodiment of the present invention, apparatus for mixing a plurality of component chemicals being delivered to a mixing container is provided. A fill probe comprises a tube-like structure having an input aperture being adapted to receive the plurality of chemical components, an output aperture being adapted to deliver the plurality of chemical components into the mixing container, and a mixer aperture. A mixer includes a mixer motor, a mixing attachment, a mixer shaft having a proximal end extending through the mixer aperture of the fill probe and being operably attached to the mixer motor and a distal end extending through the output aperture of the fill probe and being operably attached to the mixing attachment. The mixing attachment is positioned in an output flow of the chemical components from the fill probe and is positioned outside of the fill probe to mix the plurality of chemical components delivered to the mixing container through the output aperture of the fill probe.

In another embodiment, a method of mixing a plurality of component chemicals being delivered to a mixing container is provided. A fill probe includes an input aperture, an output aperture, and a tube-like structure inserted into the mixing container. The fill probe also has a mixing attachment attached thereto and extending outside the tube-like structure of the fill probe into the mixing container. Chemical components are input to the input aperture of the fill probe to deliver the chemical components into the mixing container. Motive force is applied to the mixing attachment so that the chemical components exiting the output aperture of the fill probe are mixed by the mixing attachment and the chemical components already contained in the mixing container are also mixed by the mixing attachment. Input of the chemical components to the input aperture of the fill probe is ceased, after applying motive force to the mixing attachment. Application of the motive force to the mixing attachment is maintained until the chemical components contained in the mixing container are thoroughly mixed, after the operation of ceasing input of the chemical components.

In yet another embodiment, apparatus for mixing a plurality of component chemicals being delivered to a mixing container is provided. Tube-like means deliver chemical components into the mixing container. Means for mixing the chemical components during delivery of the chemical components into the mixing container and after delivery of the chemical components into the mixing container are also provided.

These and various other features as well as other advantages, which characterize the present invention, will be apparent from a reading of the following detailed description and a review of the associated drawings.

DETAILED DESCRIPTION OF THE INVENTION

In the following descriptions of exemplary embodiments, references are made to the accompanying drawings that form a part hereof, and in which is shown by way of illustration specific embodiments in which the invention may be practiced. It is to be understood that other embodiments may be utilized as structural changes may be made without departing from the scope of the present invention.

A fill probe with an in-line mixer accelerates and facilitates automation of a fill and mix procedure used in formulating certain chemical products. In some formulas, the concentrated chemical components that combine to form the resulting formula (e.g., teat dip) have a wide range of viscosities. The in-line positioning of the mixing attachment with the fill probe on the outside of the fill probe creates a dual action mixing operation that mixes the components as they are delivered to a mixing container and continues to mix them after they are combined with other chemicals within the mixing container.

Figure 1:
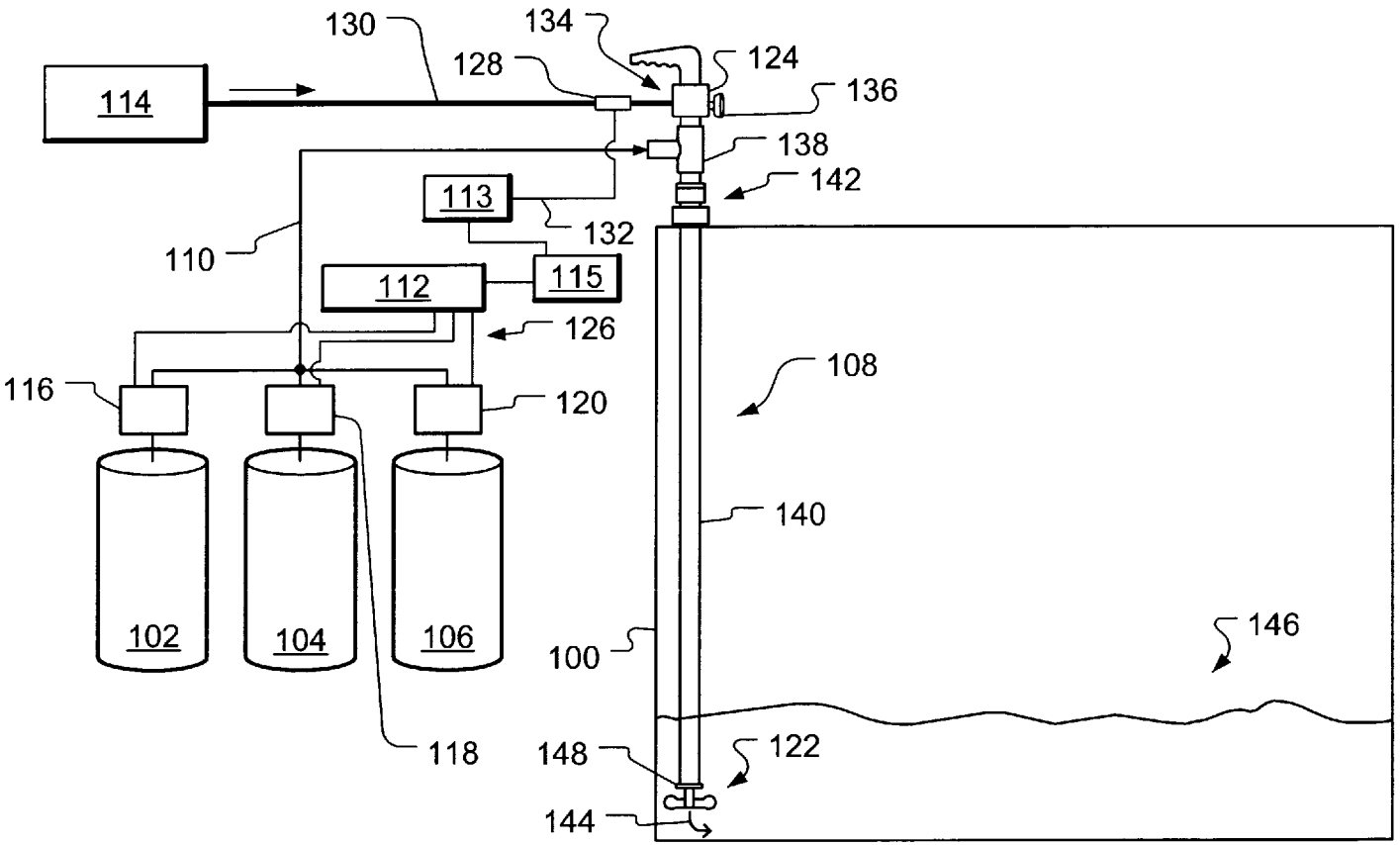
FIG. 1 illustrates a system having a fill probe with an in-line mixer attached thereto in an embodiment of the present invention.

FIG. 1 illustrates a system having a fill probe with an in-line mixer attached thereto in an embodiment of the present invention. The chemicals 146 are added to a mixing container 100, typically referred to as a "tote", a drum, or an intermediate bulk container (IBC). The mixing container 100 may have any given volume or shape. The mixing container 100 may also have a closed or open top. For example, if the end product chemical is teat dip, a closed top may be preferable to keep the teat dip free of pests, debris, etc. from the dairy barn. In contrast, a container used for mixing chemicals in a relatively clean environment, such as a food manufacturing or packaging line, may not require a closed top. The mixing container 100 includes an input hole (not shown) through which a fill probe 108 may be inserted. The input hole is commonly surrounded by a bung on the top of the mixing container 100.

In an embodiment of the present invention, chemical components are stored in component containers 102, 104 and 106, although these are illustrated as examples only. The component containers may also be referred to as "totes", drums, or IBCs. Any number, size, shape, and combination of component containers are contemplated within the scope of the present invention. In addition, some chemicals, such as water or a gas may be pumped from other sources. The individual chemical components in the illustrated embodiment are pumped from the component containers 102, 104, and 106 into the fill probe 108 via a fill line 110. Alternatively, other methods of transferring chemical components from the component containers 102, 104, and 106 are contemplated in accordance with the present invention, including pressurizing the component containers, and using gravity to output the chemical components from the containers (e.g., where the component containers are inverted).

A chemical delivery control module 112 controls the delivery of the chemical components from the component containers 102, 104, and 106 to the fill probe 108. In the illustrated embodiment, the chemical delivery control module 112 is communicatively coupled via control lines 126 to the pumps 116, 118, and 120. Control is effected by the chemical delivery control module 112 by turning on and off pumps 116, 118, and 120 at appropriate times or, if one or more of the pumps 116, 118, and 120 are variable speed pumps, controlling a pump's speed. However, other methods of controlling the delivery of the chemical components may be employed, including opening or closing a valve and/or changing a container's pressurization. Furthermore, in yet another embodiment, the chemical delivery control module 112 may control the pumps, values, etc. using mechanical or wireless means.

In the illustrated embodiment of the present invention, a mixer control module 113 controls via a control line 132 the operation of the in-line mixing attachment 122 of the fill probe 108, although the mixer control module 113 maybe integrated into a single control device with the chemical delivery control module 112 in an alternative embodiment. As illustrated, the in-line mixing attachment 122 is driven by an air-driven mixer motor 124. Typically, a compressor 114 comprises a compressor engine (not shown) and an air tank (not shown). In one embodiment, the mixer control module 113 opens and closes a valve 128 on a compressor fill line 130. Alternatively, the mixer control module 113 may be communicatively coupled a compressor control system (not shown) to control the operation of the air-driven motor 124 or another type of motor. Other known methods of controlling operation of a mixer motor may also be employed.

In FIG. 1, an air-driven mixer motor 124 is illustrated and described in association with an embodiment of the present invention. The air-driven motor 124 of the illustrated embodiment includes an input 134, a chamber containing an impeller within the air-driven motor 124, and an exhaust 136, although other configurations of air-driven motors may also be used in embodiments of the present invention. It should also be understood that other methods and apparatus for driving the in-line mixing attachment 122 are also contemplated within the scope of the present invention, including without limitation using an electric motor, a combustion engine, or a manually driven motor.

The fill probe 108 will be described in more detail with regard to FIGS. 2 and 3. However, as shown the illustrated embodiment of FIG. 1, the fill-probe 108 comprises tube-like structure including a section of polyvinyl chloride (PVC) pipe 140 and a PVC T-section 138. While various components are described as being made from PVC material, other materials are also contemplated within the scope of the present invention. An arrow 144 indicates the output flow of the chemicals delivered from the fill probe 108 into the mixing container 100.

In addition, the illustrated fill probe 108 further comprises a "cleaning cuff" 142 that fits onto the PVC pipe 140 and sits on the top surface of the mixing container 100. When the fill probe 108 is in the mixing container 100, end product chemicals 146 may adhere to the outside surface of the fill probe 108. As the fill probe 108 is withdrawn from the container (i.e., for repair or insertion into another container), the adhering chemicals or "chemical residue" can be withdrawn with the fill probe 108 and cause spillage. Accordingly, the cleaning cuff 142 fits firmly around the exterior circumference of the PVC pipe 140 and "squeezes" off a substantial amount of the chemical residue so that the residue is not spilled out in the work area.

In operation, a user typically will hold the cleaning cuff 142 against the top surface of the mixing container 100, such as on top of the bung that may surround the input hole to the container. While holding the cleaning cuff against the top surface of the mixing container 100, the user pulls the fill probe 108 out of the container, sliding the cleaning cuff 142 down the length of the PVC pipe 140. During this operation, the residue is squeezed off of the fill probe 108 and may fall back into the container mixing 100. A lip 148 prevents the cleaning cuff 142 from slipping off the end of the fill probe 108.

As illustrated, centrifugal force causes the blades or vanes of the in-line mixing attachment 122 to extend orthogonally from the mixer shaft during mixing. However, when the in-line mixing attachment 122 is not spinning, the blades can fall down in alignment with the axis of the fill probe 108 so that the in-line mixing attachment 122 can be extracted from mixing container 100 and/or the PVC pipe 140.

In many applications, it is desirable to delay the mixing operation until the mixing attachment 122 is submerged beneath the surface of the chemicals in the mixing container 100 so as to prevent excessive foaming during mixing. In an embodiment of the present invention, the mixing operation is delayed relative to the chemical component delivery operation by a chemical surface level determination module 115, which may be integrated with one or both of the chemical delivery control module 112 and the mixer control module 113 into a single control device.

In one embodiment, the chemical surface level determination module 115 comprises a timer that starts when the chemical delivery control module 112 initiates delivery of the chemical components to the fill probe and, after the timer expires, signals the mixer control module 113 to provide motive force to the mixer motor 134. In this embodiment, the timer is set to a predetermined time, which may be determined empirically or algorithmically based on the rate of chemical component delivery, that is known to ensure that the chemical surface level is above a threshold height (e.g., above the mixing attachment 122 in the mixing container 100). This time may vary based on the size and shape of the mixing container 100, the length of the fill probe 108, and the height of the mixing attachment 122 within the mixing container 100. The time may also vary depending on the amount of chemical already in the mixing container 100.

In another embodiment of the present invention, the chemical surface level determination module 115 may receive input from a chemical surface level sensor (not shown) positioned inside or outside the mixing container 100. The chemical surface level sensor senses whether the chemical surface level within the mixing container 100 is above a threshold height (e.g., above the mixing attachment 122 in the mixing container 100). Based on indications from the sensor, the chemical surface level determination module 115 can signal the mixer control module 113 to provide motive force to the mixer motor 134.

In yet another embodiment, the chemical surface level determination module 115 is coupled to one or more flow meters that measure the volume of chemical components delivered to the mixing container 100. When the flow meters indicate that a sufficient amount of chemical components have been delivered to the mixing container 100 to ensure that the chemical surface is above the mixing attachment 122 in the mixing container 100, the chemical delivery control module 112 signals the mixer control module 113 to provide motive force to the mixer motor 134. In this embodiment, the volume may be determined empirically or algorithmically to ensure that the chemical surface level is above the threshold height (e.g., above the mixing attachment 122 in the mixing container 100). The volume required may vary based on the size and shape of the mixing container 100, the length of the fill probe 108, and the height of the mixing attachment 122 within the mixing container 100. The volume required may also vary depending on the amount of chemical already in the mixing container 100.

Figure 2:
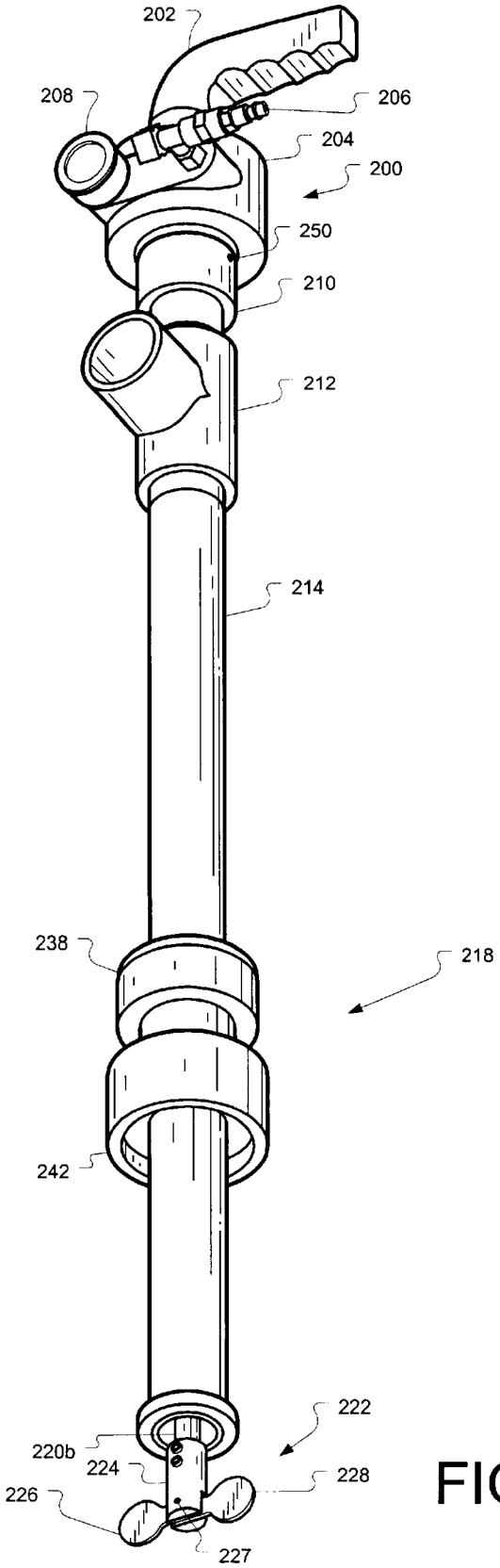
FIG. 2 illustrates an assembled fill probe with an in-line mixer attached thereto in an embodiment of the present invention.
Figure 3:
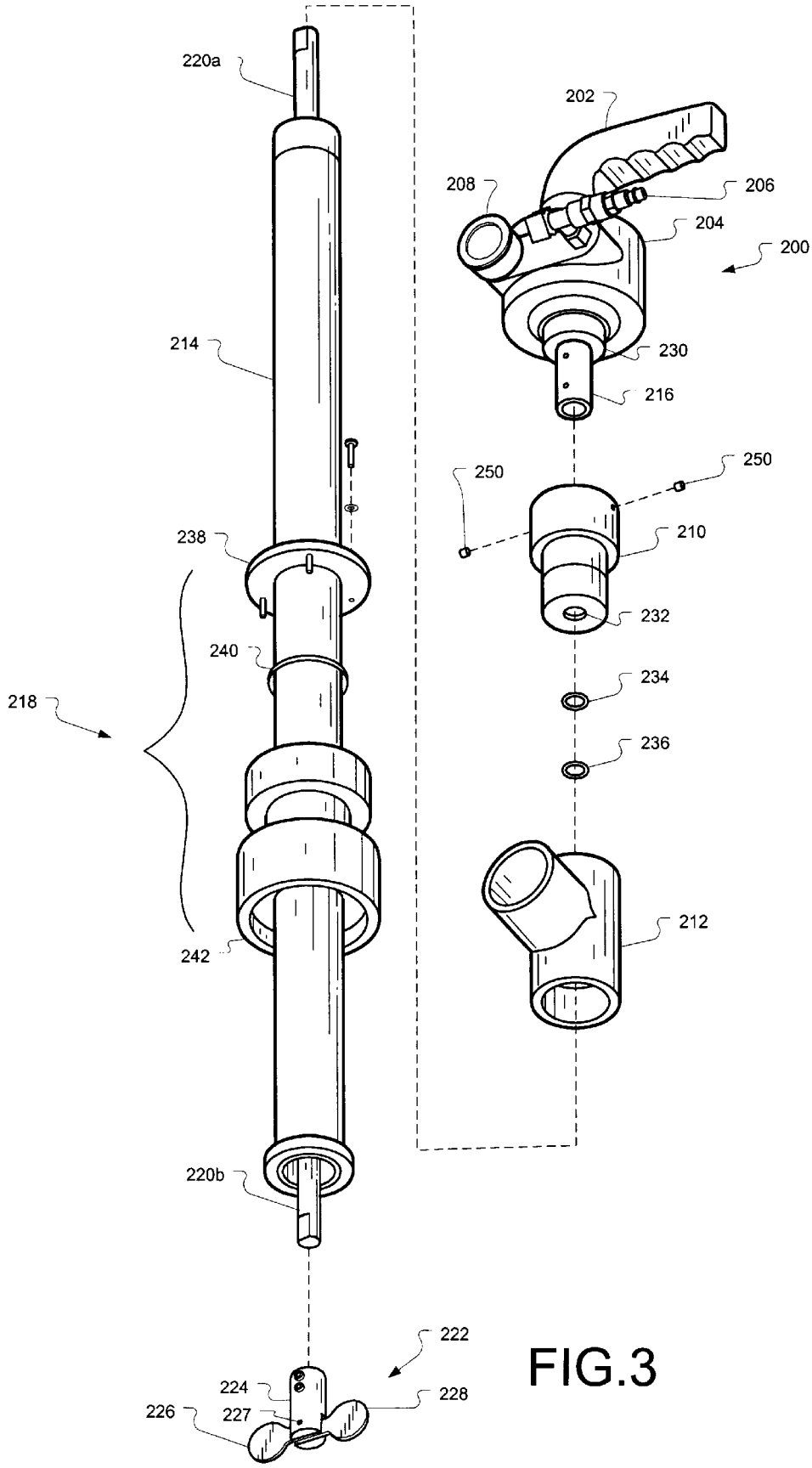
FIG. 3 illustrates an exploded view of a fill probe with an inline mixer attached thereto in an embodiment of the present invention.

FIG. 2 illustrates an assembled fill probe with an in-line mixer attached thereto in an embodiment of the present invention. FIG. 3 illustrates an exploded view of a fill probe with an inline mixer attached thereto in an embodiment of the present invention. As a component of the in-line mixer, an air-driven motor 200 includes an input port 206 (shown with an input coupling), a chamber 204 containing an internal impeller (not shown), and an exhaust port 208. A handle 202 is also attached to the air-driven motor 200. The internal impeller is operably attached to a coupler 216, which turns in a bearing assembly 230. In one embodiment, the coupler 216, the bearing assembly 230, and the air-driven motor 200 are made of stainless steel, although other materials are contemplated within the scope of the present invention.

The coupler 216 is operably attached to a mixer shaft 220, which has a proximal end 220*a* and a distal end 220*b*. The distal end 220*b* is operably attached a mixing attachment 222 by a central hub 224. Mixer blades 226 and 228 are operably attached to the central hub 224, so that when the air-driven motor 200 turns the coupler 216 and the mixer shaft 220, the mixing attachment 222 also turns. The mixer blades 226 and 228 of the illustrated embodiment are pivotally attached to the central hub 224 by a pin 227, which allows the blades 226 and 228 to lift into an orthogonal position relative to the mixer shaft 220 during operation and to fall into a more vertical orientation when the mixing attachment 222 is not spinning. In one embodiment, the mixer shaft 220 and the mixing attachment 222 are made of stainless steel, although other materials are contemplated within the scope of the present invention.

Figure 4:
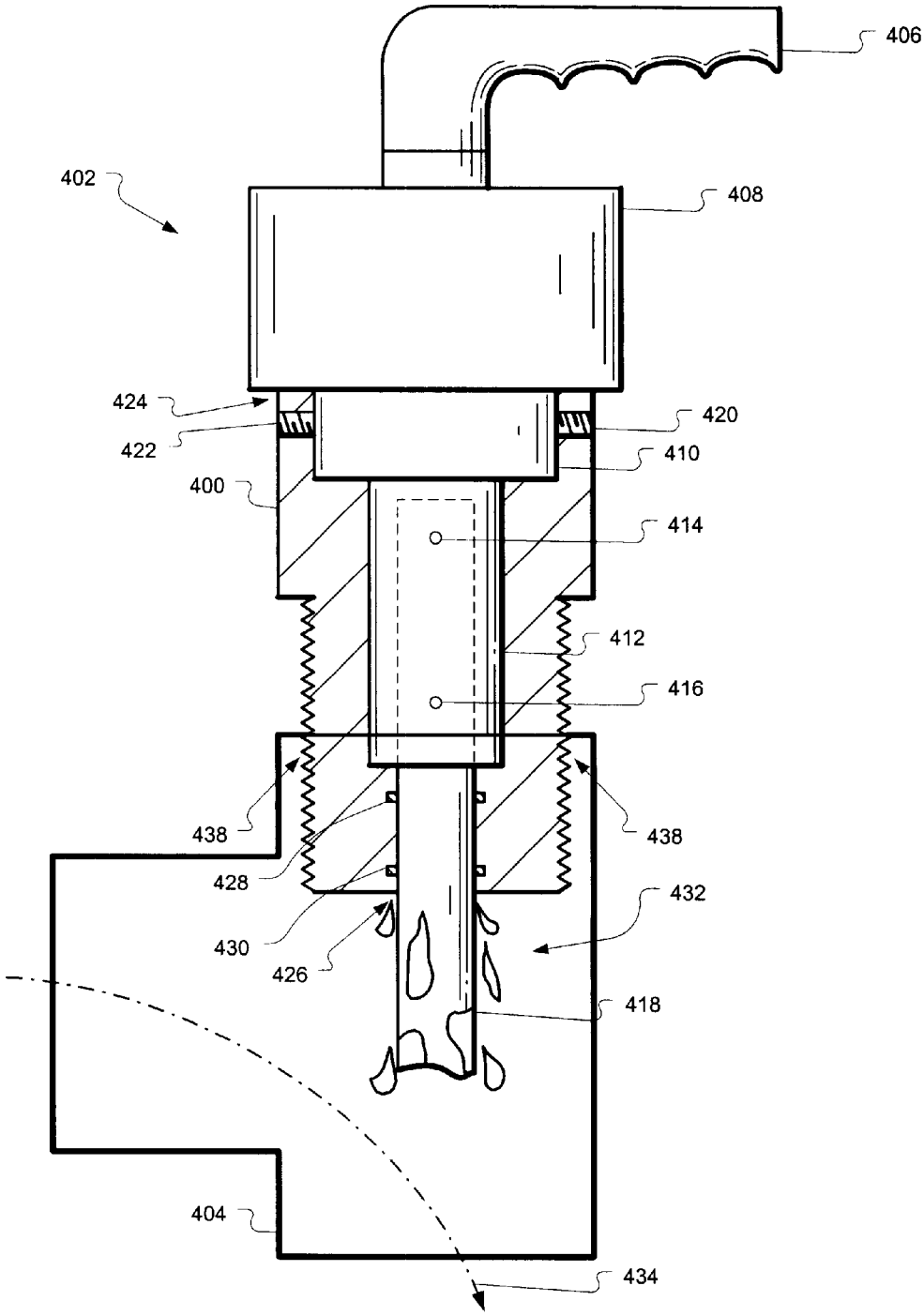
FIG. 4 illustrates a cross section of an adapter in an embodiment of the present invention.

The in-line mixer is combined with a fill probe by means of a PVC pipe 214, a PVC T-section 212, and an adapter 210. In one embodiment, the adapter 210 is made from polyvinyl chloride, although other materials are also contemplated within the scope of the present invention. The input aperture of the PVC T-section 212 (positioned at the side of the PVC T-section 212 in the illustrated embodiment) receives a fill line adapted for carrying chemical components (see fill line 110 of FIG. 1). The adapter 210 is designed to fixedly receive the bearing 230 and coupler 216 of the air-driven motor 200 into the top opening (see opening 424 in FIG. 4). The air-driven motor 200 may be secured to the adapter by set screws 250. The proximal end 220*a* of the mixer shaft 220 is attached within the adapter 210 to the drive shaft 216 and extends through the bottom opening 232 of the adapter 210. O-rings 234 and 236 fit into the lower portion of the adapter 210 (as shown in FIG. 4) and around the distal end 220*a* of the mixer shaft 220 to prevent leakage of chemicals from the PVC T-section 212 into the mixer motor 200. The mixer shaft 220 can turn within the O-rings 234 and 236 during operation.

The adapter 210 screws, frictionally fits, clamps, or is otherwise attached to a mixer aperture of the PVC T-section 212 (positioned at the top of the PVC T-section 212 in the illustrated embodiment) and prevents leakage of chemical components through the upper aperture of the PVC T-section 212. The output aperture of the PVC T-section 212 (positioned on the bottom of the PVC T-section 212 in the illustrated embodiment) is attached to the PVC pipe 214, such as by an epoxy glue commonly used to attach sections of PVC pipe together.

The PVC pipe 214 is adapted to extend into the mixing container. In one embodiment, the fill probe extends deeply into the container (as shown in FIG. 1) to prevent splashing. The mixer shaft 220 extends through the PVC pipe 214 to an output aperture of the PVC pipe 214 (positioned at the bottom of the PVC pipe 214 in the illustrated embodiment) so that the mixing attachment 222 extends outside the PVC pipe 214. In the illustrated embodiment, the mixer aperture of the PVC T-section 212 is aligned with a common axis with the output aperture of the PVC pipe 214, although other alignments are contemplated within the scope of the present invention. As such, chemical components being delivered through the fill probe may be mixed by the mixing attachment 222 as they exit the output aperture of the fill probe.

Furthermore, if the mixing attachment 222 is inserted into chemicals already in the mixing container, the mixing attachment 222 can mix those chemicals as well. However, it is often desirable to wait to operate the mixer until chemical surface level rises above the mixing attachment 222 to minimize foaming caused by the mixing of ambient air into the chemicals. Therefore, if the fill probe, and hence the mixing attachment 222, extends deeply into the container, a small volume of chemical is required to raise the chemical surface level above the mixing attachment 222. At that point, the mixer may be turned on without causing a substantial amount of foaming.

The illustrated fill probe also includes a "cleaning cuff" 218 that encompasses the external surface of the PVC pipe 214 and sits on the top of the mixing container. The cleaning cuff 218 comprises a top cap 238, and O-ring 240, and a cuff section 242. When the fill probe is removed from the mixing container, the cleaning cuff 218 can ride along the exterior surface of threaded in the corresponding section. However, alternative methods of fastening the adapter to the PVC T-section are also contemplated within the scope of the present invention, including without limitation a frictional fit, a glued junction, or a clamped junction.

One method of installing the mixer into the PVC T-section 404 includes: inserting the mixer shaft 418 through the bottom opening of the adapter 400 while the coupler 412 is still exposed; attaching the mixer shaft 418 to the coupler 412 using the set screw points 414 and 416; screwing the adapter 400 into the top section of the PVC T-section 400, pushing the mixer 402, and particularly the coupler 412 and bearing assembly 410 into the adapter 400; and securing the mixer 402 to the adapter 400 using the set screws 420 and 422. The mixer motor 408 can then be coupled to a compressor (not shown) to provide the motive force for rotating the mixer shaft 418. These operations are described as exemplary only and alternative methods of installing the mixer into the fill probe are contemplated within the scope of the present invention. In addition, the individuals operations described may be re-ordered, where appropriate.

Figure 5:
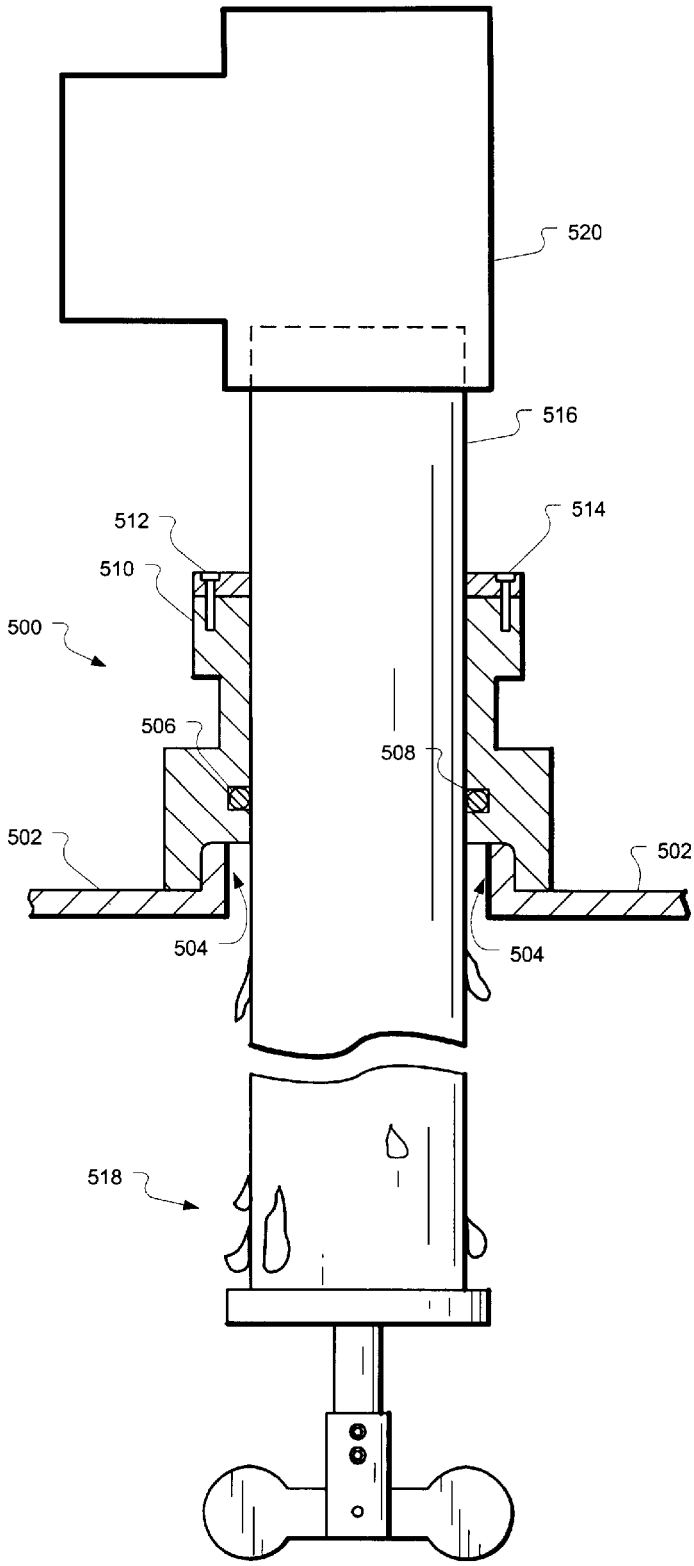
FIG. 5 illustrates a cross section of a cleaning cuff in an embodiment of the present invention.

FIG. 5 illustrates a cross section of a cleaning cuff in an embodiment of the present invention. The exemplary cleaning cuff 500 is illustrated as sitting on the top surface of a container 502, and more particularly, about a bung or boss 504 rising from the top surface of the container 502. It should be understood, however, that not all compatible containers include a bung and the illustrated embodiment would nonetheless operate acceptably on such containers. A perimeter of a PVC T-section 520 is also shown in FIG. 5.

The cleaning cuff 500 in FIG. 5 is shown as including a top cap 506, an O-ring 508, and a cuff section 510. The three sections are fastened together by fasteners 512 and 514, which may be screws, nails, or some other mechanical fasteners, or alternatively, may be glue points, weld points, or some other elements for attaching the top cap 506 to the cuff section 510. the PVC pipe 214. This movement causes the internal circumference of the cleaning cuff 218, and particularly the O-ring 240, to slide against the external circumference of the PVC pipe 214, thereby squeezing off residual chemicals that may cling to the PVC pipe 214.

FIG. 4 illustrates a cross section of an adapter in an embodiment of the present invention. The adapter 400 is shown in cross-section, operably coupling a mixer motor 402 to a PVC T-section (the perimeter of which is shown as 404). In the illustrated embodiment, the mixer motor 402 includes a handle 406, a motor chamber 408, a bearing assembly 410, and a coupler 412. The coupler 412 also includes two set screw points 414 and 416 for operably attaching the mixer shaft 418 to the mixer motor 402.

In an embodiment of the present invention, the adapter 400 includes two set screws 420 and 422 for attaching the adapter 400 to the mixer motor 402. In the illustrated embodiment, the set screws 420 and 422 press against the bearing assembly 410 to secure the adapter 400, although other configurations are also contemplated within the scope of the present invention.

The adapter 400 has a top opening (shown generally at 424) through which the bearing assembly 410 and the coupler 412 insert. The adapter 400 also has a bottom opening (shown generally at 426) through which the mixer shaft 418 extends and rotates. Two O-rings or lip seals 428 and 430 (or other elastomer materials) are positioned within the interior wall of the bottom opening 426 of the adapter 400 to seal the upper portion of the adapter 400 and the mixer motor components from exposure to the chemical components being fed in direction 434 through the PVC T-section 404. Chemical component residue 432 may also cling to the adapter 400 and the mixer shaft 418.

In one embodiment, the exterior surface 438 of the lower portion of the adapter 400 include threads to assist in fastening the adapter 400 to the PVC T-section 404, which is also The O-ring 508 presses against the exterior surface of the PVC pipe 516 of the fill probe. When the fill probe is withdrawn from the container 502, a user can hold the cleaning cuff 500 down as the PVC pipe 516 withdraws and slides up against the O-ring 508. Because the O-ring 508 squeezes the exterior surface of the PVC pipe 516, chemical residue 518 adhering to the exterior surface of the PVC pipe 516 is squeezed off as the cleaning cuff 500 slides down the PVC pipe 516.

Figure 6:
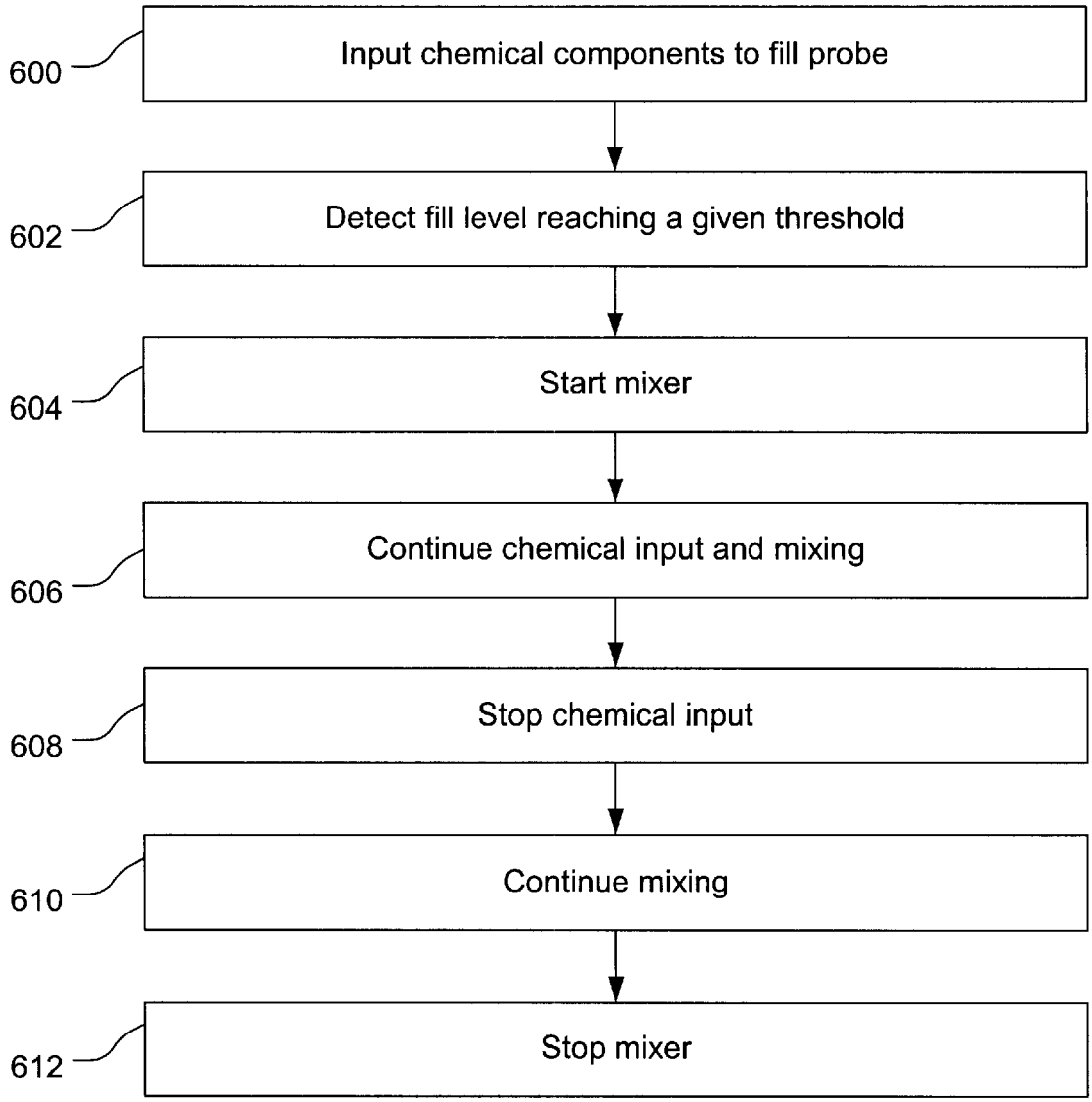
FIG. 6 illustrates operations for providing chemical components to a container using a fill probe having an in-line mixer in an embodiment of the present invention.

FIG. 6 illustrates operations for providing chemical components to a container using a fill probe having an in-line mixer in an embodiment of the present invention. Operation 600 initiates the input of chemical components to the fill probe. In one embodiment, various combinations and concentrations of chemical components may be input to the fill probe, as selected by a user or an automated selection mechanism. For example, a user may select a variety of teat dip using an input device, such as a dial or keyboard. Thereafter, a formulator can select the combination, concentrations, and amounts of chemical components to be mixed to produce the desired end-product chemical. In operation 600, this selection process results in the selected chemical components being input to the fill probe.

It should also be understood that deliver of the various chemical components need not occur simultaneously or at the same rate. For example, in one embodiment of the present invention, it is important to mix certain chemical components together before adding other chemical components. Accordingly, the first chemical components would be input and mixed before the other chemical components are delivered. In addition, the wide range of viscosities of the chemical components may cause less viscous chemical components to travel through the fill probe to the mixing container substantially faster than more viscous chemical components. As a result, continued mixing after deliver of the chemical components to the mixing container may be required.

Operation 602 detects the fill level of the end product container reaching a given threshold. In some embodiments, such as where the chemicals are not "foamy", this operation may be optional. Other exemplary embodiments, including those employing a variety of chemical surface level determination means, are described with regard to FIG. 1.

Operation 604 starts the mixer by applying a motive force to the mixer motor, which in turn applies a motive force to the mixing attachment. In one embodiment, the motive force is applied by pressurized air, but other embodiments have also been discussed. In addition, with regard to certain embodiments of the present invention, the starting of the mixer by operation 604 may be delayed until the chemical surface of the chemicals within the mixing container reach a threshold height, such as above the mixing attachment in the mixing container. In such embodiments, various means of triggering operation 604, conditioned on operation 602, may be employed within the scope of the present invention.

Operation 606 continues the delivery of chemical components to the fill probe and maintains the application of motive force to the mixer. During operation 606, the chemical components are being mixed as they exit the fill probe into the mixing container. In addition, the positioning of the mixing attachment outside the fill probe allow while also being "in-line" with the output flow of the chemical components provides for dual action mixing. The chemical components already in the mixing container (e.g., previously delivered to the mixing container during operation 600 or during a previous fill procedure) are also mixed by the mixing attachment because the mixing attachment extends beyond the distal end of the fill probe.

Operation 608 terminates the delivery of chemical components to the fill probe. Operation 610, however, maintains the motive force applied to the mixing attachment, thereby continuing to mix the chemical components contained in the mixing container. It should be understood that the dual action of mixing the chemical components during delivery as well as after delivery accelerates the rate of homogenizing the end product chemicals (or of otherwise achieving a desired mixing level—i.e., thoroughly mixed) when compared to existing in-line mixing and external mixing approaches alone. Moreover, the combination of the fill probe and the mixer facilitates automation of the end-product chemical formulation procedure. Operation 612 removes the motive force from the mixing attachment.

The above specification, examples and data provide a complete description of the manufacture and use of the composition of the invention. As many embodiments of the invention can be made without departing from the spirit and scope of the invention, the invention resides in the claims hereinafter appended.

What is claimed is:

1. An apparatus for mixing a plurality of component chemicals being delivered to a first mixing container, the apparatus comprising:

a fill probe removably positioned within the first mixing container and comprising a tube-like structure having an input aperture being adapted to receive the plurality of chemical components, an output aperture being adapted to deliver the plurality of chemical components into the first mixing container, a mixer aperture, and a handle operable for removing the fill probe from the first mixing container and inserting the fill probe into a second mixing container; and a mixer including a mixer motor, a mixing attachment, a mixer shaft having a proximal end extending through the mixer aperture of the fill probe and being operably attached to the mixer motor and a distal end extending through the output aperture of the fill probe and being operably attached to the mixing attachment, wherein the mixing attachment is positioned in an output flow of the chemical components from the fill probe and is positioned outside of the fill probe to mix the plurality of chemical components delivered to the mixing container through the output aperture of the fill probe.

2. The apparatus of claim 1 wherein the output aperture and the mixer aperture of the fill probe are aligned on a common axis, the output aperture being located in the distal end of the fill probe along the common axis and the mixer aperture being located in the proximal end of the fill probe along the common axis.

3. The apparatus of claim 1 further comprising:

an adapter having a bottom opening and a top opening and being removably attached to the mixer aperture of the fill probe, wherein the bottom opening is adapted to rotatably receive the proximal end of the mixer shaft and the top opening is adapted to fixedly receive the mixer motor.

4. The apparatus of claim 1 further comprising at least one lip seal positioned in the bottom opening of the adapter to allow rotation of the mixer shaft and to seal the adapter against leakage of the chemical components from the fill probe to the mixer motor through the adapter.

5. The apparatus of claim 1 further comprising at least one O-ring positioned in the bottom opening of the adapter to allow rotation of the mixer shaft and to seal the adapter against leakage of the chemical components from the fill probe to the mixer motor through the adapter.

6. The apparatus of claim 1 further comprising an elastomer material positioned in the bottom opening of the adapter to allow rotation of the mixer shaft and to seal the adapter against leakage of the chemical components from the fill probe to the mixer motor through the adapter.

7. An apparatus for mixing a plurality of component chemicals being delivered to a mixing container, the apparatus comprising:

a fill probe comprising a tube-like structure having an input aperture being adapted to receive the plurality of chemical components, an output aperture being adapted to deliver the plurality of chemical components into the mixing container, and a mixer aperture;

a mixer including a mixer motor, a mixing attachment, a mixer shaft having a proximal end extending through the mixer aperture of the fill probe and being operably attached to the mixer motor and a distal end extending through the output aperture of the fill probe and being operably attached to the mixing attachment, wherein the mixing attachment is positioned in an output flow of the chemical components from the fill probe and is positioned outside of the fill probe to mix the plurality of chemical components delivered to the mixing container through the output aperture of the fill probe;

a chemical delivery control module controlling the delivery of the plurality of chemical components to the fill probe; and a mixer control module controlling motive force delivered to the mixer motor.

8. The apparatus of claim 7 wherein the plurality of chemical components delivered to the mixing container form a chemical surface within the mixing container and further comprising:

a chemical surface level determination module communicatively coupled to the mixer control module and the chemical delivery control module and conditioning delivery of the motive force to the mixer motor on the chemical surface in the mixing container being above a threshold height.

9. The apparatus of claim 8 wherein the threshold height is designated to be above the mixing attachment when the fill probe is inserted into the mixing container.

10. The apparatus of claim 8 wherein a determination of whether the chemical surface is above the threshold height is based on a predetermined time of delivery of the chemical components.

11. The apparatus of claim 8 wherein a determination of whether the chemical surface is above the threshold height is based on a signal received from a sensor detecting whether the chemical surface is above the threshold height in the mixing container.

12. The apparatus of claim 8 wherein a determination of whether the chemical surface is above the threshold height is based on a measured volume of the chemical components being delivered to the mixing container.

13. The apparatus of claim 7 further comprising at least one lip seal positioned in the bottom opening of the adapter to allow rotation of the mixer shaft and to seal the adapter against leakage of the chemical components from the fill probe to the mixer motor through the adapter.

14. The apparatus of claim 7 further comprising at least one O-ring positioned in the bottom opening of the adapter to allow rotation of the mixer shaft and to seal the adapter against leakage of the chemical components from the fill probe to the mixer motor through the adapter.

15. The apparatus of claim 7 further comprising an elastomer material positioned in the bottom opening of the adapter to allow rotation of the mixer shaft and to seal the adapter against leakage of the chemical components from the fill probe to the mixer motor through the adapter.

16. An apparatus for mixing a plurality of component chemicals being delivered to a mixing container, the apparatus comprising:

a fill probe comprising a tube-like structure having an input aperture being adapted to receive the plurality of chemical components, an output aperture being adapted to deliver the plurality of chemical components into the mixing container, a mixer aperture, and an exterior surface along the tube-like structure;

a mixer including a mixer motor, a mixing attachment, a mixer shaft having a proximal end extending through the mixer aperture of the fill probe and being operably attached to the mixer motor and a distal end extending through the output aperture of the fill probe and being operably attached to the mixing attachment, wherein the mixing attachment is positioned in an output flow of the chemical components from the fill probe and is positioned outside of the fill probe to mix the plurality of chemical components delivered to the mixing container through the output aperture of the fill probe; and a cleaning cuff positioned on the exterior surface of the fill probe to clean residual chemicals from the exterior surface of the fill probe when the cleaning cuff slides along the tube-like structure.

17. The apparatus of claim 16 further comprising at least one lip seal positioned in the bottom opening of the adapter to allow rotation of the mixer shaft and to seal the adapter against leakage of the chemical components from the fill probe to the mixer motor through the adapter.

18. The apparatus of claim 16 further comprising at least one O-ring positioned in the bottom opening of the adapter to allow rotation of the mixer shaft and to seal the adapter against leakage of the chemical components from the fill probe to the mixer motor through the adapter.

19. The apparatus of claim 16 further comprising an elastomer material positioned in the bottom opening of the adapter to allow rotation of the mixer shaft and to seal the adapter against leakage of the chemical components from the fill probe to the mixer motor through the adapter.

20. A method of mixing a plurality of component chemicals being delivered to a mixing container, the method comprising:

providing a fill probe having an input aperture, an output aperture, and a tube-like structure inserted into the mixing container, the fill probe further having a mixing attachment attached thereto and extending outside the tube-like structure of the fill probe into the mixing container;

inputting chemical components to the input aperture of the fill probe to deliver the chemical components into the mixing container;

applying motive force to the mixing attachment so that the chemical components exiting the output aperture of the fill probe are mixed by the mixing attachment and the chemical components already contained in the mixing container are also mixed by the mixing attachment;

ceasing input of the chemical components to the input aperture of the fill probe, after applying motive force to the mixing attachment; and maintaining application of the motive force to the mixing attachment until the chemical components contained in the mixing container are thoroughly mixed, after the operation of ceasing input of the chemical components.

21. A method of mixing a plurality of component chemicals being delivered to a mixing container, wherein the chemical components delivered to the mixing container form a chemical surface therein, the method comprising:

providing a fill probe having an input aperture, an output aperture, and a tube-like structure inserted into the mixing container, the fill probe further having a mixing attachment attached thereto and extending outside the tube-like structure of the fill probe into the mixing container;

inputting chemical components to the input aperture of the fill probe to deliver the chemical components into the mixing container;

applying motive force to the mixing attachment so that the chemical components exiting the output aperture of the fill probe are mixed by the mixing attachment and the chemical components already contained in the mixing container are also mixed by the mixing attachment, wherein application of the motive force to the mixing attachment, relative to the operation of inputting chemical components to the input aperture of the fill probe, is delayed until the chemical surface within the mixing container is determined to be above a threshold height;

ceasing input of the chemical components to the input aperture of the fill probe, after applying motive force to the mixing attachment; and maintaining application of the motive force to the mixing attachment until the chemical components contained in the mixing container are thoroughly mixed, after the operation of ceasing input of the chemical components.

22. The method of claim 21 wherein the threshold height is designated to be above the mixing attachment when the fill probe is inserted into the mixing container.

23. The method of claim 21 wherein a determination of whether the chemical surface is above the threshold height is based on a predetermined time of delivery of the chemical components.

24. The method of claim 21 wherein a determination of whether the chemical surface is above the threshold height is based on a signal received from a sensor detecting whether the chemical surface is above the threshold height in the mixing container.

25. The method of claim 21 wherein a determination of whether the chemical surface is above the threshold height is based on a measured volume of the chemical components being delivered to the mixing container.

26. A method of mixing a plurality of component chemicals being delivered to a mixing container, the method comprising:

providing a fill probe having an input aperture, an output aperture, a tube-like structure inserted into the mixing container, and an exterior surface along the tube-like structure, the fill probe further having a mixing attachment attached thereto and extending outside the tube-like structure of the fill probe into the mixing container;

inputting chemical components to the input aperture of the fill probe to deliver the chemical components into the mixing container;

applying motive force to the mixing attachment so that the chemical components exiting the output aperture of the fill probe are mixed by the mixing attachment and the chemical components already contained in the mixing container are also mixed by the mixing attachment;

ceasing input of the chemical components to the input aperture of the fill probe, after applying motive force to the mixing attachment;

maintaining application of the motive force to the mixing attachment until the chemical components contained in the mixing container are thoroughly mixed, after the operation of ceasing input of the chemical components.

sliding a cleaning cuff along the exterior surface of the fill probe to clean residual chemicals from the exterior surface of the fill probe.

* * * * *